US010330434B2

(12) United States Patent
Jones

(10) Patent No.: US 10,330,434 B2
(45) Date of Patent: Jun. 25, 2019

(54) FIREARM SIGHTING DEVICE

(71) Applicant: Anchor Point Solution, Inc., Okeechobee, FL (US)

(72) Inventor: Lee C. Jones, Okeechobee, FL (US)

(73) Assignee: Anchor Point Solutions, Inc., Okeechobee, FL (US)

( * ) Notice: Subject to any disclaimer, the term of this patent is extended or adjusted under 35 U.S.C. 154(b) by 0 days.

(21) Appl. No.: 15/692,948

(22) Filed: Aug. 31, 2017

(65) Prior Publication Data

US 2018/0087868 A1 Mar. 29, 2018

Related U.S. Application Data

(60) Provisional application No. 62/381,743, filed on Aug. 31, 2016.

(51) Int. Cl.
*F41C 27/00* (2006.01)
*F41G 11/00* (2006.01)

(52) U.S. Cl.
CPC ..... *F41C 27/00* (2013.01); *F41G 11/00* (2013.01)

(58) Field of Classification Search
CPC ..... F41C 27/00; F41G 11/00
USPC ..... 42/90, 94
See application file for complete search history.

(56) References Cited

U.S. PATENT DOCUMENTS

| | | | | |
|---|---|---|---|---|
| 183,975 | A * | 10/1876 | Rosee | F41C 23/16 42/71.01 |
| 455,827 | A * | 7/1891 | Duncan | F41C 23/16 42/71.01 |
| 788,467 | A * | 4/1905 | Henderson | F41G 1/473 42/111 |
| 803,791 | A * | 11/1905 | Shattuck | F41G 1/473 42/111 |
| 2,432,519 | A | 12/1947 | Garand | |
| 3,740,886 | A * | 6/1973 | Canon | F41A 23/02 42/72 |
| 4,852,287 | A * | 8/1989 | Martin | F41C 27/00 42/72 |
| 7,810,270 | B2 | 10/2010 | Fitzpatrick et al. | |
| 8,763,296 | B1 | 7/2014 | Chvala | |
| 2014/0196343 | A1* | 7/2014 | Wilson | F41C 23/14 42/71.01 |

OTHER PUBLICATIONS

Rubber Hardness Chart, Mykin Inc. [http://mykin.com/rubber-hardness-chart] (Year: 2018).*
Cowboy, G., "Halix Innovations NSN: No stock needed", Internet article: http://www.populararairsoft.com/halix-innovations-nsn-no-stock-needed, (Sep. 6, 2012).

* cited by examiner

*Primary Examiner* — Samir Abdosh
(74) *Attorney, Agent, or Firm* — McHale & Slavin, P.A.

(57) ABSTRACT

An improved long gun construction is provided. A gun is provided with a kisser device mounted to the butt stock; the kisser device having a flexible projection positioned to engage a portion of the shooter's head, e.g., a corner of the mouth, to assist the shooter in consistently positioning the head to better align the shooter's visual line of sight with the guns line of sight.

7 Claims, 5 Drawing Sheets

FIREARM SIGHTING DEVICE

RELATED APPLICATIONS

In accordance with 37 C.F.R 1.76, a claim of priority is included in an Application Data Sheet filed concurrently herewith. Accordingly, the present invention claims priority to U.S. Provisional Patent Application No. 62/381,743, filed Aug. 31, 2016, entitled "Firearm Sighting Device", the contents of the above referenced application is herein incorporated by reference in its entirety.

FIELD OF THE INVENTION

The present invention involves a sighting device for use on firearms. More particularly, the present invention includes a firearm sighting device to assist in effecting proper and consistent aiming of long guns, which includes shotguns and rifles.

BACKGROUND OF THE INVENTION

Firearms have been available for centuries. In particular, long guns, which include shotguns and rifles, have been in use since at least the $17^{th}$ century. They utilize one or more projectiles which traverse the gun's barrel from pressurized gas formed by igniting a propellant. Sights have also been provided on such guns for centuries to improve the odds of successfully having the projectile(s) engage the target. Such guns can use open or closed sights or a single sight. Rifles typically have a front sight and a rear sight, while a shotgun typically has only a front sight. However, some shotguns that fire a single projectile can be provided with front and rear sights, and are commonly referred to as slug guns.

Utilizing both a front and rear sight improves shooting effectiveness. However, shotguns shooting shot shells typically rely on the skill of the shooter to effect proper aiming. Some of the shooters shoot in a manner called "instinct shooting" where basically, based on the shooter's experience, the gun is pointed from experience and the sight may not be used at all. However, many shooters do not have the experience to shoot this way or have fallen out of practice if they have not shot in a while. The less experienced shooter will utilize the front sight, and use the receiver top as a second or rear sight. However, positioning his/her head against the butt stock of the gun so that the eye is in proper alignment with the line of sight defined by the front sight and the receiver can take a period of time. When shooting skeet, trap, sporting clays or even hunting, the shooter does not have time to look down the barrel to effectively align the line of sight and the target. The shooter should instead focus solely on the target, and alignment of the gun should occur from alignment of the gun to the shooter's body.

Another problem with shooting long guns is recoil. For many long guns, recoil can be substantial, causing the gun to move backwards relative to the shooter and, in particular, the butt stock will typically move backwards relative to the cheek and jaw of the shooter, sometimes a substantial distance. Recoil felt by the shooter is determined at least in part by the amount of propellant shot, the weight of the gun, and the energy released by the propellant. The configuration of the gun also has an impact on recoil. During recoil, the entire gun and attachments move rearward, causing the shoulder of the shooter to also move rearward. Much of the total recoil energy is absorbed by the shooter and some is absorbed by the gun.

There is thus a need for a device for assisting the shooter to quickly effect alignment of the shooter's visual line of sight with the gun's line of sight that does not adversely affect the shooter from gun recoil. This is especially important when more than one target is involved. For example, "true pairs" in sporting clay shooting requires the shooter to make quick and proper alignment after recoil from the first target shot to accurately complete the second target shot.

DESCRIPTION OF THE PRIOR ART

Sighting assist devices are known in the art. One such device, known as a kisser, is used on bows. It assists the archer in consistently reaching an anchor point for the nock end of the arrow, while a front sight mounted to the bow handle forms front and rear sights to more effectively aim the bow. The kisser can be used with an auxiliary rear sight attached to the bow string.

U.S. Pat. No. 788,467, issued in 1905, discloses a sight finder that has a knob 4 for positioning at the corner of the mouth to achieve consistent alignment of the eye's line of sight with the gun sights. The sight finder appears to be permanently secured to the butt stock. The only movement in the structure is longitudinal movement of the knob 4. The knob 4 is fixed in spacing from the cheek side of the butt stock. It also appears that the knob 4 could cause damage to the corner of the mouth during recoil.

SUMMARY OF THE INVENTION

The present invention involves the provision of an improved sight finder that can be used on long guns to help align a shooter's visual line of sight with the gun sight(s).

Accordingly, it is a primary objective of the instant invention to provide a sighting device that accommodates recoil induced contact of the device with the shooter.

It is a further objective of the instant invention to provide a sighting device that accommodates storage of the gun with mounted sighting device in a gun storage case.

It is yet another objective of the instant invention to provide a sighting device that can be easily mounted and removed without stock modification.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
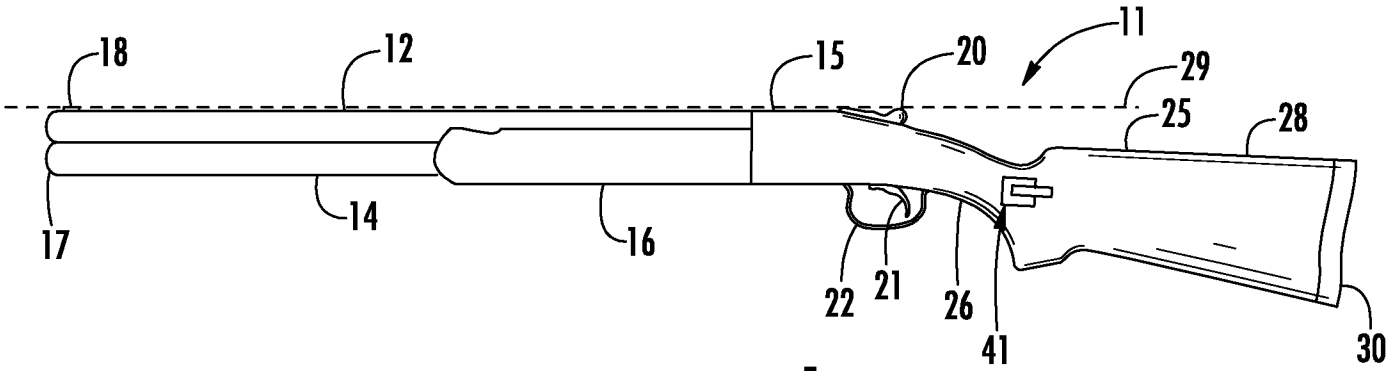
FIG. 1 is a side elevation view of a long gun with a sighting device mounted on the butt stock.

FIG. 1 illustrates a long gun in the form of an over-and-under double barrel shotgun, designated generally 11. While a double barrel shotgun is shown, it is to be understood that other forms of long guns can be utilized with the present invention. The gun 11, as shown, includes barrels 12, 14 that are attached to and project forwardly from the receiver 15, which houses portions of the action (not shown). A forearm 16 is also provided for gripping by a shooter's hand to stabilize and support the muzzle or distal end 17 of the gun 11. Generally, a front sight 18 in the form of a bead for shotguns is attached to the upper barrel 12 at the muzzle end 17. The front sight 18 can be of any suitable form, such as a brass bead, luminescent plastic bead or white bead as desired. The bead 18 and the top of the receiver 15 define a sighting plane usable by the shooter to aim the gun 11. In the case of a break action shotgun, a lever 20 is provided to allow the shooter to open the gun, exposing the breach end of the barrels for loading and unloading. When opening such a gun, the barrel or barrels pivot on a hinge pin (not shown) mounted to the forward part of the receiver 15 and an ejector or extractor (not shown) moves the spent shell. A trigger 21 and trigger guard 22 are also provided. The trigger 21 and trigger guard 22 are positioned on the underside of the receiver 15 and the forward end of the butt stock 25. The butt stock 25 projects rearwardly from the receiver 15. The butt stock 25 can be in one of several forms; for example, a straight grip or a pistol grip. The grip portion of the butt stock 25 is designated generally 26. The top or comb 28 of the butt stock 25 is utilized by the shooter for engagement with the shooter's cheek. Some shotguns and rifles are provided with an adjustable comb 28 as a means to better position the shooter's visual line of sight with the gun sight's line of sight 29. The butt stock 25 is typically provided with a recoil pad 30 to help absorb some of the recoil energy. The construction of long guns is well known in the art.

Neither the line of sight 29, nor the shooter's line of sight, is typically well defined relative to one another, particularly when there is no rear sight. The skill of the shooter compensates for this deficiency. The present gun construction improves on this by providing an improved gun construction which includes a butt stock mounted kisser device, designated generally as 41.

The kisser device 41 includes means, designated generally 43, for attachment to the butt stock 25 and a projection 45. In the illustrated structure, the means 43 includes a base 47 and a securement device 49. Preferably, the base 47 and projection 45 are an integral structure and of molded construction. As shown, the base 47 is in the form of a flexible plate, flexible enough to conform to the contour of the butt stock 25. The attachment device 49 is in the form of a double-sided adhesive pad 51 adhered to an inside face 53 of the base 47. The pad 51 has an inside face 55 that provides an adhesive face for securement to an outer face of the butt stock 25. Preferably, the base 47 is sufficiently flexible to allow it to conform to the shape of the butt stock 25 when it is secured thereto with the attachment device 49. In a preferred embodiment, the attachment device 49 is constructed to allow its detachment from the butt stock 25 in an easy manner. These adhesive pads are preferably constructed from silicone or a polymeric material with an adhesive layer on both sides. Such adhesive devices are known in the art, and are used on Command brand hangers where stretching of the adhesive pad allows its selective detachment from what the pad is adhered to. It has also been found that Scotch Brand acrylic adhesive dots can also be used.

Figure 2:
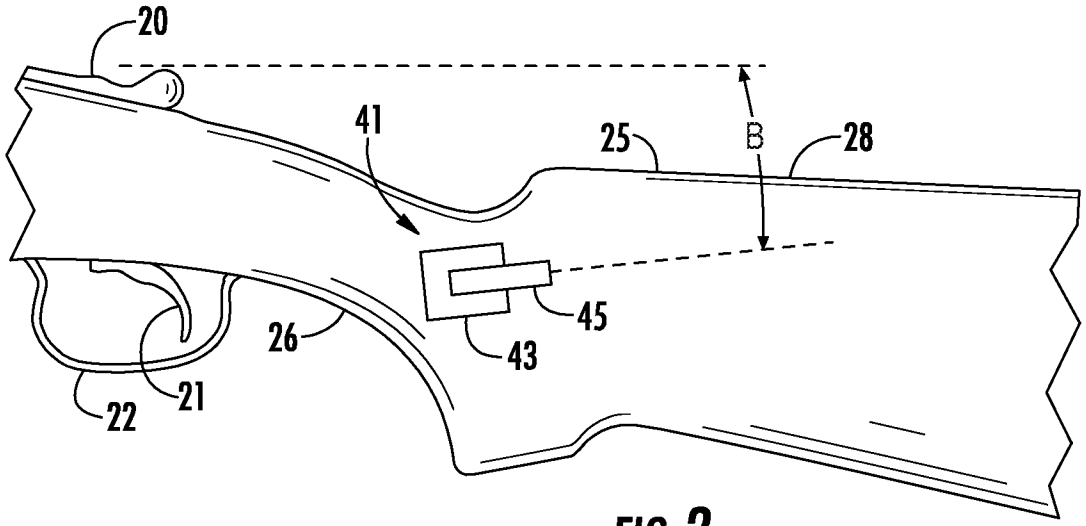
FIG. 2 is an enlarged fragmentary side view of the sighting device and a portion of the butt stock.
Figure 3:
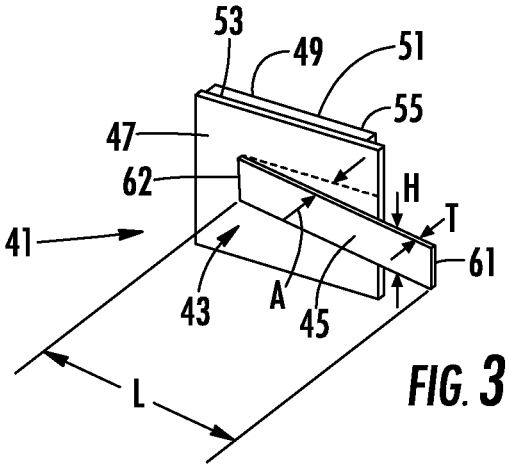
FIG. 3 is an enlarged perspective view of the sighting device.

The kisser device 41 includes a projection 45. In the illustrated embodiment, the projection 45 is in the form of an arm that has a free end 61 and an attached end 62. From the attached end 62 to the free end 61, the projection 45 is spaced from the base 47 and projects at an angle, A, from the outer face of the base 47. The projection 45 in the illustrated structure on FIG. 3 shows that its height dimension, H, exceeds its thickness dimension, T. Preferably, the height H is at least 4 times the thickness T for the embodiment illustrated in FIGS. 1-3. This allows for bending of the projection 45, principally toward and away from the butt stock 25. In a most preferred but non-limiting embodiment, the projection 45 is angled up (angle B) at about a 45 degree angle and back toward the rear of the gun by about 10-15 degrees (angle A). It has been found that this compound angle places the tip of the projection 45 near the edge of the mouth of the shooter. By reversing the orientation of these angles, bending of the projection 45 can be in the reverse direction, or up and down for the configuration of the kisser device 41 illustrated in FIG. 2. Preferably, the projection 45 is curved to bias the projection 45 to bend inwardly about its attached end 62 during recoil so its free end 61 will pass by the shooter's mouth. The projection thus has a concave curvature to its inner surface and a convex curvature to its outer surface.

In a preferred embodiment, the base 47 and projection 45 are of an integral structure and can be formed by a molding process. The material used to form the base 47 and projection 45 is preferably an elastomer or plastic polymer. Examples of such material include rubber, silicone rubber, polyethylene, polypropylene and the like. The material can also be of a type that allows it to be reformed to a desired configuration by the temporary application of heat, i.e., thermoformable or heat formable. The physical properties of the material selected and the dimensions thereof are such as to allow the projection 45 to bend when coming into contact with the shooter's head, for example, at the corner of the shooter's mouth when a shot is fired. The hardness of the material, particularly for the projection 45, should be on the order of less than about 90 when measured on a Shore A scale. The anticipated bending of the projection 45 should be within the elastic limit of the material used. The projection 45 is configured to move toward the butt stock 25 to allow it to collapse and be adjacent the butt stock for storage of the gun 11 in a case, and return to its original position when removed from confinement. Also, the modulus of elasticity (Young's Modulus) needs to be low enough to provide the structural rigidity to hold the projection 45 in a desired position for positioning the shooter's head while allowing easy bending during recoil. Likewise, the area moment of inertia of the projection 45 needs to be selected to allow for the proper bending of the projection 45 during shooting while also supporting the projection 45 in the desired normal position. The projection 45 has a length L between the ends 61, 62 in the range of between about ½ inch and about 2 inches.

In the illustrated embodiment, the projection 45 is shown as having its attached end 62 located generally centrally on the base 47. It is to be understood, however, that the attached end 62 could be adjacent or at an edge of the base 47, for example, at the rear positioned edge of the base 47 as seen in FIG. 2.

Figure 5:
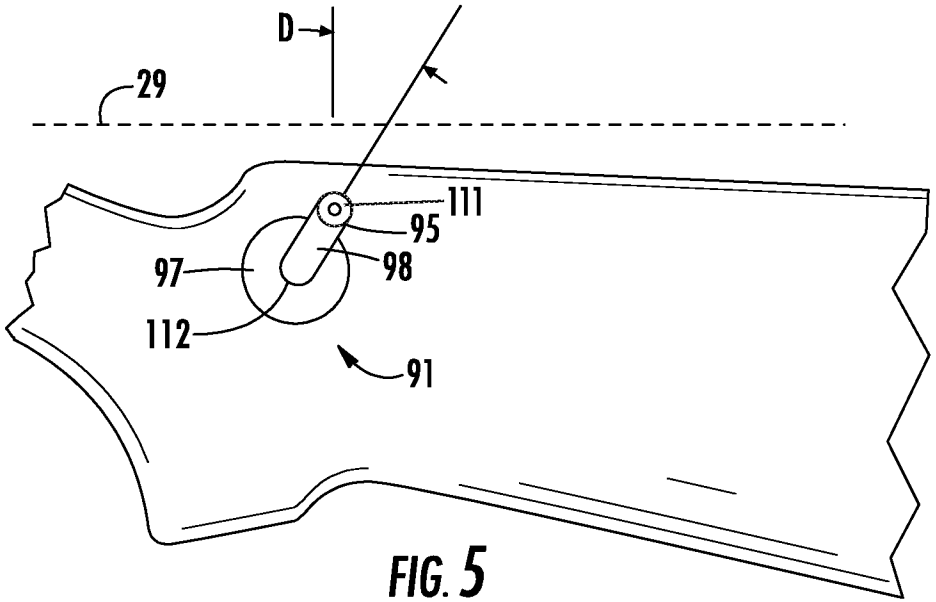
FIG. 5 is an enlarged side elevation view of an alternate sighting device mounted on a butt stock.

FIG. 5 shows another embodiment of a kisser device, designated as 91. The kisser device 91 is constructed for orientation of its projection 95 in a more vertical orientation than the kisser device 41 which is oriented in a more horizontal orientation. The kisser device 91 is removably mounted to the butt stock with an adhesive pad 51, described above, attached to the base 97. Preferably, the securement of the device 91 to the butt stock 25 is a removable securement as described herein. Orientations discussed herein are relative to the line of sight 29 being substantially horizontal. As shown, the longitudinal axis of the projection 95 is at an angle D relative to the line of sight of between about plus or minus 30° from normal to the line of sight 29. The kisser device 91 includes a projection 95. In the illustrated embodiment of FIG. 5, the projection 95 is in the form of an arm that has a free end 111 and an attached end 112. From the attached end 112 to the free end 111, the projection 95 is spaced from the base 97 and projects at an angle, C, from the outer face of the base 97. The angle C is in the range of between about 15° and about 40° relative to the longitudinal central plane of the butt stock 25. The projection 95 has a length L1 between the ends 111, 112 in the range of between about 0.5 inches and about 1.5 inches. The length L1 of the projection 95 in combination with the angle C are such that the free end 111 is spaced from the butt stock a distance E between about ¼ inch and 1.5 inches.

In a preferred embodiment, the base 97 and projection 95 are of an integral structure and can be formed by a molding process. The material used to form the base 97 and projection 95 is preferably an elastomer or plastic polymer. Examples of such material include rubber, silicone rubber, polyethylene, polypropylene and the like. In a preferred but non limiting embodiment, the base 97 and projection 95 can be a composite with an inner layer of plastic polymer and an over molded layer 98 of an elastomer, such as silicone rubber. The base polymer material can also be of a type that allows it to be reformed to a desired configuration by the temporary application of heat, i.e., thermoformable or heat formable. The physical properties of the material selected and the dimensions thereof are such as to allow the projection 95 to bend when coming into contact with the shooter's head, for example, at the corner of the shooter's mouth when a shot is fired. The hardness of the material, particularly for the projection 95, should be on the order of less than about 90 when measured on a Shore A scale. The anticipated bending of the projection 95 should be within the elastic limit of the material(s) used. The projection 95 is configured to move toward the butt stock 25 to allow it to collapse and be adjacent the butt stock for storage of the gun 11 in a case, and return to its original position when removed from confinement. Also, the modulus of elasticity (Young's Modulus) needs to be low enough to provide the structural rigidity to hold the projection 95 in a desired position for positioning the shooter's head while allowing easy bending during recoil. Likewise, the area moment of inertia of the projection 95 needs to be selected to allow for the proper bending of the projection 95 during shooting while also supporting the projection 95 in the desired normal position.

Figure 6:
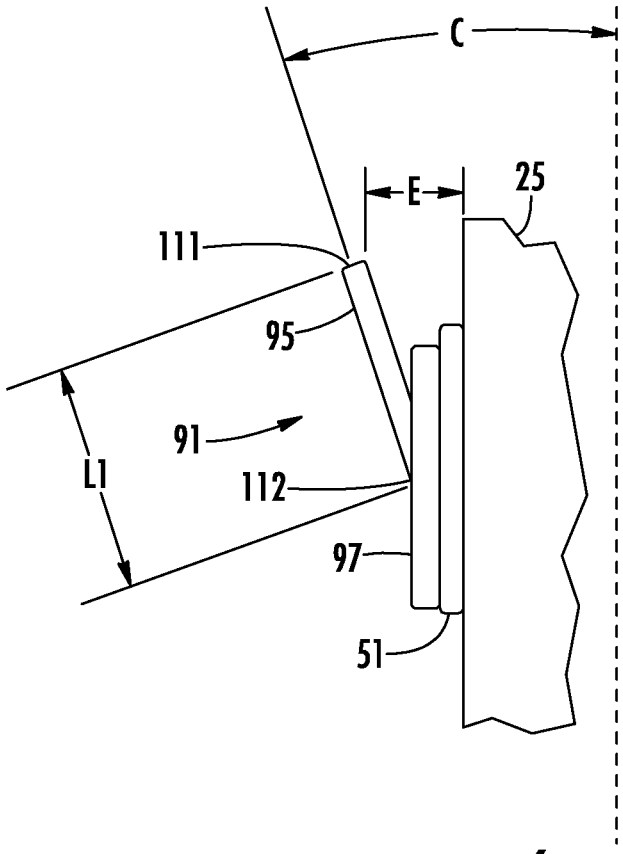
FIG. 6 is an enlarged end elevation view of the sighting device shown in FIG. 5.

In the illustrated embodiment, the projection 95 is shown as having its attached end 112 located generally centrally on the base 97. It is to be understood, however, that the attached end 112 could be adjacent or at an edge of the base 97, for example, at the top positioned edge of the base 97 as seen in FIGS. 5, 6.

Figure 4:
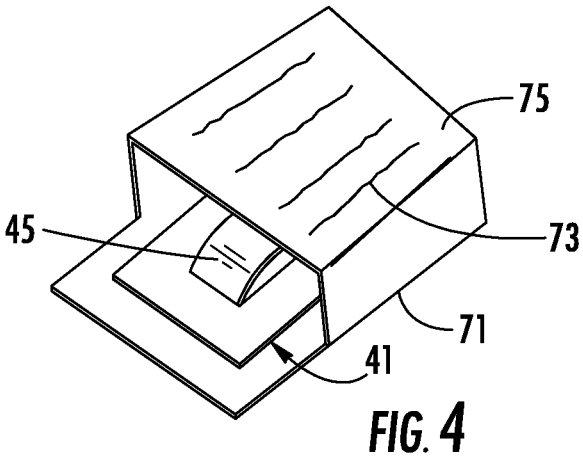
FIG. 4 is an enlarged perspective view of the sighting device in a package with instructions.

The sales packaging containing the device 41, or device 91, is preferably associated with instructions on how to mount and demount the device 41 or 91 and how to orient and adjust the position of the device relative to the butt stock 25 and/or the line of sight 29. As seen in FIG. 4, a package 71 is provided for storing the sighting device 41 in the interior of the package. The package 71 includes written instructions 73 as an insert or on a panel 75 of the package. The instructions 73 can be provided electronically as by disclosing a link to a website where the instructions can be accessed.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A long gun having a butt stock, the gun including
a barrel;
a receiver having the barrel mounted thereto;
a butt stock mounted to the receiver; and
a kisser device adhesively secured to the butt stock, said device having a base secured to the butt stock and a projection attached to the base, said projection having opposite end portions with one end portion being attached to the base and the other end portion being a free end and spaced outwardly of the base and butt stock and movable toward and away from the butt stock when engaging a shooter discharging the gun, wherein the projection being in the form of an arm having height and thickness with the height being larger than the thickness, said outward spacing being initially sufficient to have the free end engage a portion of the shooter's face before discharge of the firearm and wherein the projection being curved to bias the projection to bend inwardly about its attached end during recoil so its free end will pass by a shooter's mouth.

2. The gun of claim 1 wherein the kisser device being removably adhesively secured to the butt stock.

3. The gun of claim 1 wherein the height is at least 4 times the thickness.

4. The gun of claim 2 wherein the projection being in the form of an arm with opposite ends and having length in the range of between ½ inch and 1½ inches.

5. The gun of claim 4 wherein at least the arm having hardness, at least on its outer surface, of less than 90 Shore A.

6. The gun of claim 4 wherein the arm being positioned at an angle of between plus or minus 30° from normal to a line of sight of the gun and at an angle of between 15° and 40° from a central longitudinal plane of the butt stock.

7. A kisser device adapted for mounting on a butt stock of a long gun, said device including:

a base adapted for securement to a butt stock;

a projection attached to the base, said projection having opposite end portion with one end portion being attached to the base and the other end portion being a free end and spaced outwardly of the base and movable toward and away from the base when engaging a shooter discharging a gun to which the device is secured, said outward spacing being initially sufficient to have the free end engage a portion of a shooter's face before discharge of the firearm, said projection having an inner surface with a concave curvature and an outer surface with a convex curvature; and instructions associated with the device and providing instructions on mounting the base to a butt stock.

* * * * *